US006032296A

United States Patent [19]

Kelly et al.

[11] Patent Number: 6,032,296

[45] Date of Patent: Mar. 7, 2000

[54] SUPPORT/SPORT SOCK AND METHOD OF USE

[75] Inventors: Graham M. Kelly, 917 McDiarmid La., Grand Ledge, Mich. 48837; Ray M. Fredericksen, Haslett, Mich.

[73] Assignee: Graham M. Kelly, Grand Ledge, Mich.

[21] Appl. No.: 09/247,743

[22] Filed: Feb. 9, 1999

Related U.S. Application Data

[63] Continuation-in-part of application No. 08/741,954, Oct. 31, 1996, Pat. No. 5,898,948.

[51] Int. Cl.[7] ..... A41B 11/00

[52] U.S. Cl. ..... 2/240; 2/239

[58] Field of Search ..... 2/239–240, 242, 2/409; 36/113, 114; 66/178–178 R, 169 R, 171, 182–188; 602/62, 23

[56] References Cited

U.S. PATENT DOCUMENTS

| | | | |
|---|---|---|---|
| 963,878 | 7/1910 | Diver | 2/239 |
| 2,574,873 | 11/1951 | Jobst . | |
| 2,816,361 | 12/1957 | Jobst . | |
| 4,156,294 | 5/1979 | Horn | 2/409 |
| 4,172,456 | 10/1979 | Zens . | |
| 4,180,065 | 12/1979 | Bowen | 2/239 |
| 4,194,249 | 3/1980 | Thorneburg | 2/239 |
| 4,277,959 | 7/1981 | Thorneburg | 2/239 |
| 4,373,215 | 2/1983 | Guigley | 2/239 |
| 4,397,161 | 8/1983 | Chesebro, Jr. et al. | 2/239 |
| 4,502,301 | 3/1985 | Swallow et al. . | |
| 4,513,740 | 4/1985 | Westlake . | |
| 4,520,635 | 6/1985 | Shields et al. | 2/239 |
| 4,862,523 | 9/1989 | Lipoy | 2/409 |
| 5,086,518 | 2/1992 | Staley | 2/239 |
| 5,263,923 | 11/1993 | Fujimoto . | |
| 5,367,708 | 11/1994 | Fujimota | 2/239 |

*Primary Examiner*—Gloria M. Hale

*Attorney, Agent, or Firm*—Gifford, Krass, Groh, Sprinkle, Anderson & Citkowski, P.C.

[57] ABSTRACT

A support/sport sock for enhancing athletic performance and method of use. The sock includes a sock body of an elastomeric material which exhibits a pressure gradient against the calf of the leg which varies from a maximum proximate the foot portion of the sock to a minimum at the top end. The sock may include a padded portion extending along the plantar surface and a wicking material. The sock is used to enhance athletic performance.

6 Claims, 1 Drawing Sheet

SUPPORT/SPORT SOCK AND METHOD OF USE

This application is a continuation-in-part of application Ser. No. 08/741,954, U.S. Pat. No. 5,898,948 filed on Oct. 31, 1996.

FIELD OF THE INVENTION

This invention concerns the field of athletic apparel and, more particularly, a sport sock designed to enhance the wearer's athletic performance.

BACKGROUND OF THE INVENTION

Elastic compression stockings have long been used for the treatment of chronic venous insufficiency (CVI). Generally, such "anti-embolism" stockings extend over the wearer's leg and foot and are adapted to exhibit a controlled, gradient compressive force on the leg. Typically, the compressive force is greatest at the ankle area and diminished over the length of the stocking to a minimum at the top. Examples of such compression hosiery are disclosed in, for example, U.S. Pat. Nos. 4,172,456; 4,502,301; 4,513,740; 2,574,873 and 2,816,361.

CVI is defined as any abnormality of the peripheral venous system that reduces or restricts venous return, thereby causing blood pooling and increased venous pressure. Patients exhibiting such blood pooling and increased venous pressure are at increased risk for developing blood clots in their legs, with the attendant risk of the clots breaking loose and traveling through the venous circulation back to the heart and into the lungs, thus leading to a potentially fatal pulmonary embolism. CVI includes a spectrum of circulatory problems, including vein competency, patency and wall properties, as well as extravascular factors. These extravascular factors include the muscle pumps of the foot, calf and thigh which are in turn dependent on proper neuromuscular function and mobility of the joints (particularly the ankle) and connective tissue support by fascia.

The spectrum of symptoms attributed to those afflicted with CVI includes lower leg extremity pain, itching, burning, fatigue, cramps, swelling, and in advanced stages, ulceration of the lower leg. Gradient compression of the leg is highly effective in reducing lower extremity venous pressure and venous pooling. This enables the calf muscle pump to increase venous return. Thus, CVI patients undergoing compression hose therapy are usually relieved of nearly all symptoms, including ulceration.

While gradient compression stockings are in widespread use for the treatment of CVI, they have not heretofore generally been used by those who are free of this disease. Because they are restricted to medical applications, the compression hosiery are usually physician prescribed or are available over the counter upon the recommendations of a physician.

Aerobic type exercise is increasingly becoming a part of the normal fitness regime. The benefits of such exercise need not be discussed in detail here, but include reduced incidence of coronary disease, greater stamina and strength, increased energy levels, increased longevity, etc. Thus, a large number of healthy adults engage in such aerobic exercise on a regular basis.

While undoubtedly beneficial, aerobic exercise and other athletic activities involving the strenuous use of the lower extremities carry certain risks. In particular, the lower leg, ankle, and foot include a number of intricate intrinsic muscle and joint complexes. Instability of the foot and ankle joint complexes resulting from excessive pronation and supination, with added impact trauma to the lower leg, has been associated with a number of overuse injuries. These injuries include Achilles tendinitis, peroneal tendinitis, and plantar fasciitis. The motion of pronation is characterized by inward rotation of the lower leg upon the foot causing the arches to flatten out. Supination involves an outward rotation of the lower leg resulting in high arches in the foot.

Conventional methods of stabilizing the foot and reducing trauma to the lower leg include arch supports, specially designed athletic shoes such as high top basketball shoes, and various athletic training taping procedures. U.S. Pat. No. 5,263,923, for example, discloses a wearing article including highly stretchable portions which extend along the muscle groups of a body portion in order to simulate a "taping" function. These prior art methods have all produced somewhat limited benefits.

Thus, both "weekend" and serious athletes could benefit from increased protection of these intricate muscle and joint complexes. Furthermore, increased blood flow through the lower extremities could well give these athletes a "boost" in performance, as well as reducing fatigue and pain caused by build up of lactic acid within the muscles, as well as reducing the likelihood of developing CVI.

Thus, what is needed is a device which both enhances the performance of casual and serious athletes in an easy to use and nonintrusive manner, and which also provides the added benefit of protecting the user from injury and disease.

What is also needed is a new use for gradient compression stockings which offers enhanced athletic performance.

SUMMARY OF THE INVENTION

The invention described herein has been designed to overcome the deficiencies in the prior art noted above. The invention is a support/sport sock designed to cover the leg of a wearer and a novel method of using the sock to enhance athletic performance. The support/sport sock includes a sock body having a foot portion configured to enclose the wearer's foot. A cushioning member, either in the form of a heel pad or a region of increased thickness, is disposed in a heel area of the sock portion to cushion and protect the wearer's heel when the wearer is engaged in activity. Alternatively, it may cover the whole plantar surface of the sock.

The sock body further includes a calf portion which extends up the leg of the wearer for a distance and terminates in a proximal end. In one embodiment of the support/sport sock of the present invention, the calf portion of the sock body extends up to the wearer's knee. In a second embodiment, the calf portion extends only partially up the wearer's calf to form a "crew" length sock. In yet another embodiment, the sock body extends up the wearers thigh and joins that of the other leg to form a sport tight.

The sock body is comprised of an elastomeric material (such as a spandex or spandex blend knit) which exerts a compressive force against the wearer's leg. The compressive force exhibits a gradient which varies from a maximum at the foot or ankle of the sock body to a minimum at the proximal end. Such a compressive force gradient can be formed in any manner known in the prior art, such as varying the tension of the elastomeric yarn when the sock is knitted, using panels of compressive forces, using yarns of different elasticity, etc. However the gradient force is achieved, it will cause the sock of the present invention to enhance the natural pumping action of the wearer's calf muscles and increase venous return to the heart. This, in turn, causes increased blood flow into the legs of the user, which increases the amount of available oxygen to the muscle cells of the legs, and enhances athletic performance.

Judicious selection of yarns may provide the sock of the present invention with even additional benefits. Antimicrobial and antifungal textiles or textile coatings may be employed. An insulating hollow core synthetic material, such as Thermax® (manufactured by the Dupont Corporation) may be used in the yarn to improve the stocking's heat retention capabilities.

Preferably, the support/sport sock of the present invention further includes a layer of a relatively hydrophobic material (such as the polypropylene fiber Cool Max®, manufactured by the Dupont Corporation) disposed on the inside of the sock body. This layer of material functions as a wicking gradient to wick perspiration generated by the wearer while engaged in activity to the outside surface of the sock, thus lending to the comfort of the device.

In another embodiment, the sock may further comprise an athletic shoe or other type of footwear.

The sock of the present invention is used to enhance athletic performance.

BRIEF DESCRIPTION OF THE DRAWINGS

The following detailed description is best understood by reference to the following drawings in which.

DETAILED DESCRIPTION OF THE PREFERRED EMBODIMENTS

Figure 1:
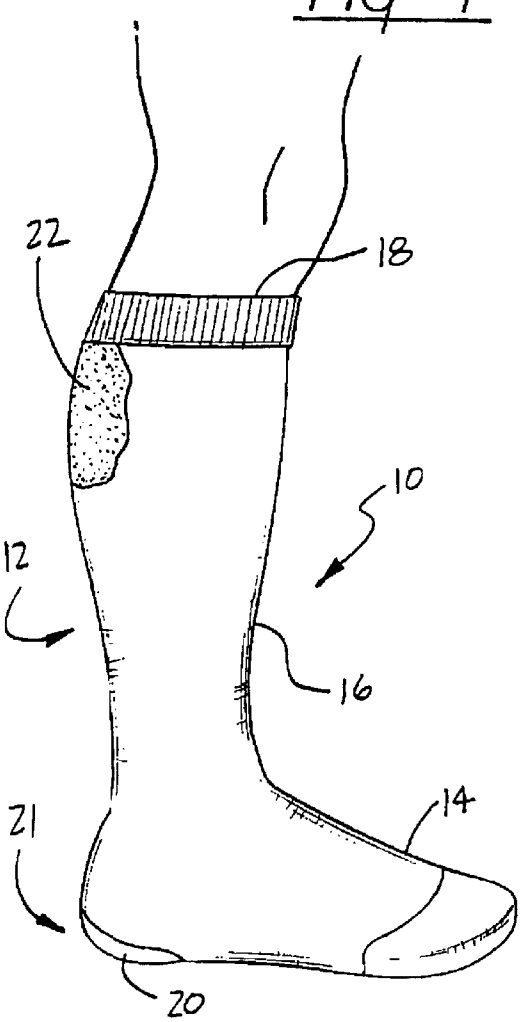
FIG. 1 is a right side (lateral) view of a first embodiment of a support/sport sock constructed in accordance with the principles of the present invention.

Throughout the following detailed description, like numerals are used to reference the same elements of the present invention shown in multiple figures thereof. Referring now to the drawings, and in particular to FIG. 1, there is shown a first embodiment of a bio-physio support/sport sock 10 according to the present invention. The sock 10 includes a sock body 12 having a foot portion 14 and a calf portion 16. The calf portion extends up the wearer's leg to the knee and terminates in a proximal end 18.

The sock body 12 is comprised of an elastomeric material (such as a spandex or spandex blend knit, or similar material) which exerts a compressive force against the wearer's leg. The compressive force is graded throughout the calf portion 16 so that it various from a maximum at foot portion 14 to a minimum at said remote end 18. The yarn may have an antimicrobial or antifungal material knitted into it, or may have an antimicrobial or antifungal coating applied to it after it is spun or knitted. It is particularly advantageous to use an insulating hollow core synthetic Dupont Thermaxl® for a stocking with enhanced heat retention.

The support/sport sock 10 shown in FIG. 1 further includes a pad 20 disposed in the heel area 21 of foot portion 14. Typically, pad 20 is comprised of a visco-elastic material, although other suitable materials may be used. Alternatively, it may comprise a region of more thickly knitted yarn. The purpose of pad 20 is to enhance cushioning and improve shock absorption when the wearer is engaged in physical activity. Although not depicted, the pad may extend along the entire plantar surface of the foot.

As will be discussed in the experimental data below, the embodiment of the present invention shown in FIG. 1 can enhance athletic performance. Specifically, by reducing venous pooling and increasing venous return, and reducing wasted muscle motion, exercise capacity can increase, and the performance of even those individuals not affected by CVI can be enhanced. Preferably, the sock includes a layer 22 of relatively hydrophobic material (such as Dupont Cool Max®) which lines the inside of the sock body 12 in order to create a wicking gradient and wick perspiration to the outside of the sock 10, thus improving its comfort of the support/sport sock 10. The combination of the hydrophobic layer 22, the pad 20 and the pressure gradient results in a unique sports sock particularly adapted to athletic use.

Although the embodiment of FIG. 1 shows a knee high sock, in actual fact the height of the sock of the present invention may range from the popliteal fossa, at the knee joint, to crew length at the midpoint of the calf muscle. The knee length design delivers maximum function to enhance venous blood return and stabilize the entire lower leg anatomy. The crew height sock provides compression and stability but to a lesser degree and is particularly suitable for activities where coolness and comfort dictate over function.

Figure 2:
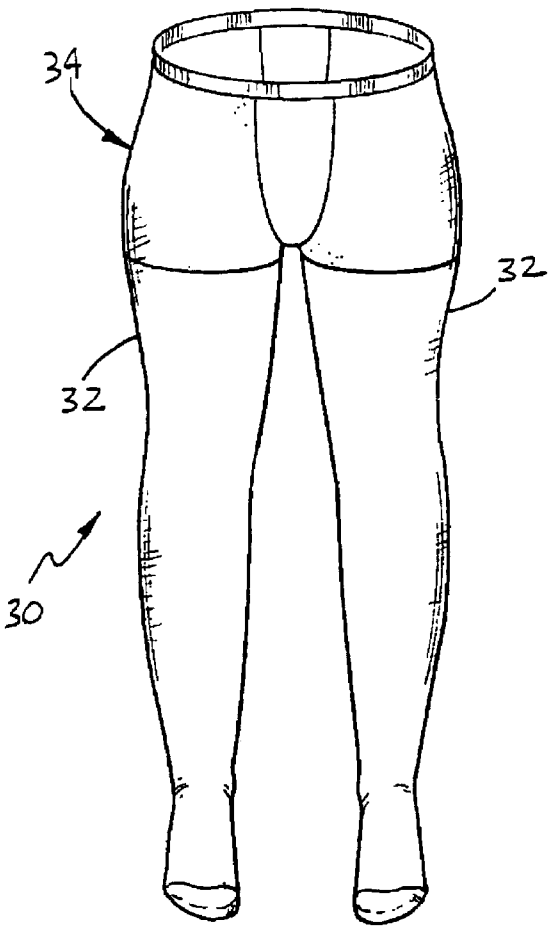
FIG. 2 is a front view of a second embodiment of the sock of the present invention.

In an alternative embodiment 30 of the sock of the present invention shown in FIG. 2, a sock body 32 extends all the way up each leg of the user to join a knitted brief 34, thus forming a sport tight 30.

Figure 3:
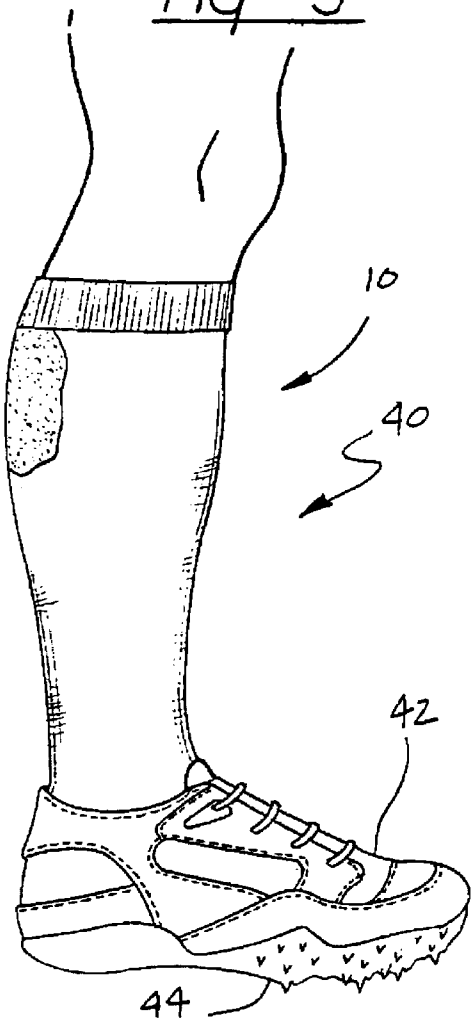
FIG. 3 illustrates an embodiment of the sock of the present invention incorporating an athletic shoe.

The embodiment depicted in FIG. 3 incorporates a convention racing or athletic shoe 40 incorporated into the sock 10. The shoe 40 includes an upper 42 and a shoe sole system 44.

The incidence of venous disease is estimated to be 50% of the population. This population is also shifting largely to an age group over 50, when the effects of venous disease are most noticeable. Exercise has become more than a passing fad for this age group, and it is responsible for purchasing a large and growing percentage of sporting equipment. Any device that can potentially enhance performance, improve venous function, and reduce pains associated with aging will be enthusiastically embraced. For the younger athlete or healthy older individual, the support/sport sock of the present invention is more physiologic and may offer additional benefits as well. It should be noted that current "running tights" are not designed with a pressure gradient, and may actually reduce venous return. In sharp contrast to the present invention, such tights may result in diminished performance.

EXPERIMENTAL

Aerobic exercise performance is dependent on two main factors: a) aerobic capacity ($VO_{2max}$) and b) the % of $VO_{2max}$ which can be used effectively during intense competition.

Maximal Exercise

Stated quite simply, $VO_{2max}$ is equal to the product of maximal:

$$\text{heart rate} \times \text{stroke volume} \times a\text{-}vO_2\text{difference}$$

Mathematically speaking, if one could increase any of these variables without negatively affecting the others, his/her $VO_{2max}$ would increase.

Heart rate is obvious. In this case, we are interested in maximal heart rate. This is largely independent of training, may be negatively influenced by therapeutic drugs (i.e., blood pressure medication) and would not likely be affected by the SOCK.

a–v $O_2$ difference is the amount of $O_2$ that can be extracted in the muscles. Literally, it is the amount of $O_2$ in the arterial blood entering the muscle capillaries, minus the amount of $O_2$ in the venous blood leaving the capillaries. It is also known as $O_2$ "extraction". This is a "peripheral" variable that varies from muscle to muscle within an individual, depending on level and type of training. We are basically talking about enzyme capabilities of individual muscle fibers, so the SOCK would not likely affect this variable.

On the other hand, Stroke Volume could very well be affected by the SOCK. During exercise, stroke volume (the amount of blood pumped per heart beat) increases by a) higher levels of circulating catecholamines such as epinephrine and b) increasing venous return to the heart. By increasing venous return, we mean simply that the "muscle pump" of the arms and legs helps return blood to the heart quickly, so it can be pumped out again. All things being equal, the more blood returned to the heart in a given amount of time, the more pumped out. While the muscles do a good job of squeezing the veins to aid this process during exercise, it is possible that the SOCK could aid this effort. We know that the deep veins of the legs, and the skin area are very compliant and can hold a great deal of blood volume. By adding external pressure from the SOCK, this compliance may be reduced, and venous return increased. If this occurs, Stroke Volume could increase and increase $VO_{2max}$.

Tables A and B show, respectively, the results comparing these factors for a subject (23 year old female) tested with (Table A) and without (Table B) the sock of the present invention. We see a 5% increase in $O_{2pulse}$ (which is an indirect index of stroke volume) during the SOCK trial (results included). This resulted in a 2–2.5% increase in $VO_{2max}$.

TABLE A

| MIN | SPEED | GRADE | WORK | HR | 02 PULS | VE BTPS | RR | TV | SBP | DBP | VO2 | V02/KG | R |
|---|---|---|---|---|---|---|---|---|---|---|---|---|---|
| EXERCISE | | | | | | | | | | | | | |
| 00:01:00 | 2.7 | | | 99 | 4.8 | 17.2 | 19 | 0.90 | | | 480 | 7.75 | 0.97 |
| 00:02:00 | 3.2 | | | 104 | 8.1 | 21.5 | 18 | 1.19 | | | 844 | 13.61 | 0.78 |
| 00:03:00 | 3.7 | | | 110 | 9.2 | 28.2 | 23 | 1.21 | | | 1010 | 16.29 | 0.84 |
| 00:04:00 | 4.2 | | | 123 | 9.3 | 33.3 | 27 | 1.25 | | | 1136 | 18.32 | 0.88 |
| 00:05:00 | 4.7 | | | 136 | 11.2 | 49.1 | 30 | 1.61 | | | 1520 | 24.51 | 0.98 |
| 00:06:00 | 5.2 | | | 144 | 12.3 | 62.6 | 35 | 1.81 | | | 1774 | 28.62 | 1.06 |
| 00:07:00 | 5.7 | | | 149 | 12.2 | 66.6 | 38 | 1.74 | | | 1815 | 29.27 | 1.03 |
| 00:08:00 | 6.0 | 1.6 | 26 | 155 | 13.2 | 70.4 | 40 | 1.77 | | | 2044 | 32.97 | 0.98 |
| 00:09:00 | 6.0 | 4.7 | 77 | 161 | 14.5 | 81.0 | 46 | 1.78 | | | 2326 | 37.52 | 0.97 |
| 00:10:00 | 6.0 | 7.5 | 122 | 167 | 15.4 | 88.5 | 45 | 1.95 | | | 2560 | 41.30 | 0.98 |
| 00:11:00 | 6.0 | 10.6 | 173 | 174 | 16.7 | 109.7 | 54 | 2.03 | | | 2903 | 46.82 | 1.07 |
| 00:12:00 | 6.0 | 13.6 | 222 | 177 | 17.5 | 122.5 | 64 | 1.91 | | | 3104 | 50.06 | 1.12 |
| ACTIVE RECOVERY | | | | | | | | | | | | | |
| 00:12:20 | 2.5 | 8.0 | 54 | 176 | 12.5 | 85.6 | 53 | 1.62 | | | 2207 | 35.60 | 1.18 |

TABLE B

| MIN | SPEED | GRADE | WORK | HR | 02 PULS | VE BTPS | RR | TV | SBP | DBP | VO2 | V02/KG | R |
|---|---|---|---|---|---|---|---|---|---|---|---|---|---|
| BASELINE | | | | | | | | | | | | | |
| 00:01:00 | | | | 96 | 2.9 | 13.9 | 16 | 0.87 | | | 273 | 4.43 | 1.24 |
| EXERCISE | | | | | | | | | | | | | |
| 00:02:00 | 2.7 | | | 120 | 3.8 | 21.6 | 21 | 1.03 | | | 453 | 7.34 | 1.17 |
| 00:03:00 | 3.2 | | | 122 | 5.3 | 22.3 | 20 | 1.13 | | | 648 | 10.50 | 0.92 |
| 00:04:00 | 3.7 | | | 128 | 7.0 | 24.7 | 20 | 1.23 | | | 895 | 14.51 | 0.80 |
| 00:05:00 | 4.2 | | | 134 | 8.4 | 31.4 | 23 | 1.38 | | | 1123 | 18.20 | 0.86 |
| 00:06:00 | 4.7 | | | 139 | 10.7 | 40.9 | 23 | 1.74 | | | 1489 | 24.14 | 0.89 |
| 00:07:00 | 5.2 | | | 150 | 11.5 | 53.6 | 31 | 1.74 | | | 1721 | 27.89 | 0.96 |
| 00:08:00 | 5.6 | | | 156 | 10.9 | 58.3 | 33 | 1.75 | | | 1701 | 27.57 | 1.00 |
| 00:09:00 | 6.0 | 1.6 | 26 | 161 | 11.9 | 64.6 | 35 | 1.84 | | | 1912 | 30.99 | 0.97 |
| 00:10:00 | 6.1 | 4.6 | 75 | 164 | 13.1 | 70.5 | 40 | 1.75 | | | 2158 | 34.98 | 0.95 |
| 00:11:00 | 6.0 | 7.6 | 123 | 170 | 14.4 | 81.4 | 43 | 1.88 | | | 2453 | 39.75 | 0.96 |
| 00:12:00 | 6.0 | 10.6 | 173 | 175 | 15.9 | 95.0 | 49 | 1.94 | | | 2792 | 45.25 | 1.01 |
| 00:13:00 | 6.0 | 13.6 | 220 | 181 | 16.7 | 114.7 | 61 | 1.88 | | | 3024 | 49.02 | 1.10 |
| ACTIVE RECOVERY | | | | | | | | | | | | | |
| 00:13:40 | 2.5 | 7.8 | 53 | 174 | 6.I | 41.1 | 26 | 1.60 | | | 1057 | 17.13 | 1.14 |

Thus, the support/sport sock of the present invention, when used in an exercise setting, offers improved cardiovascular return, thus both enhancing athletic performance, and helping to prevent the development of CVI in susceptible individuals. Additionally, the sock of the present invention has the great advantage that it may be purchased off the shelf without a medical prescription. It is easy to put on and comfortable to wear.

While the support/sport sock of the present invention has been described with reference to certain embodiments and exemplifications thereof, the invention is not limited to the exact depicted designs. One of skill in the art, having had the benefit of the teachings of the present invention, may design certain variations thereof without departing from the scope of the present invention. Thus, it is the claims appended hereto, as well as all reasonable equivalents thereof, rather than the exact depicted embodiments, which define the true scope of the present invention.

We claim:

1. A support/sport sock for covering the leg of a wearer and comprising:

a sock body including a foot portion configured to enclose said wearer's foot and a calf portion extending up the leg of said wearer and terminating in a proximal end, said sock body comprised of an elastomeric material formed to exert a compressive force against said leg, wherein said elastomeric material provides said compressive force as being graded throughout the calf portion such that said gradient varies from a maximum proximate said foot to a minimum at said proximal end;

a cushioning member disposed along the plantar surface of said sock portion to cushion and protect a portion of said wearer's foot when said wearer is engaged in activity; and a layer of hydrophobic material disposed on an inside surface of said sock body to create a wicking gradient from said inside surface to the outside of the sock.

2. The sock of claim 1 further comprising a pair of sock bodies configured to extend all the way up the legs of the user, and a brief attached to said pair of sock bodies to form a pair of tights.

3. The sock of claim 1 further comprising a shoe upper and sole attached to said sock body.

4. A support/sport sock for covering the leg of a wearer and comprising:

a sock body including a foot portion configured to enclose said wearer's foot and a calf portion extending up the leg of said wearer and terminating in a proximal end, said sock body comprised of an elastomeric material formed to exert a compressive force against said leg, wherein said elastomeric material provides said compressive force as being graded throughout the calf portion such that said gradient varies from a maximum proximate said foot to a minimum at said proximal end;

a cushioning member disposed along the plantar surface of said sock portion to cushion and protect a portion of said wearer's foot when said wearer is engaged in activity, wherein said sock body is knitted of a hollow core synthetic yarn for enhanced heat retention.

5. A support/sport sock for covering the leg of a wearer and comprising:

a sock body including a foot portion configured to enclose said wearer's foot and a calf portion extending up the leg of said wearer and terminating in a proximal end, said sock body comprised of an elastomeric material formed to exert a compressive force against said leg, wherein said elastomeric material provides said compressive force as being graded throughout the calf portion such that said gradient varies from a maximum proximate said foot to a minimum at said proximal end;

a cushioning member disposed along the plantar surface of said sock portion to cushion and protect a portion of said wearer's foot when said wearer is engaged in activity, wherein said sock body incorporates a biocidal substance.

6. A method of enhancing athletic performance by wearing a pair of sport socks, each said method comprising the steps of:

providing a sock body including a foot portion configured to enclose said wearer's foot and a calf portion extending up the leg of said wearer and terminating in a proximal end, said sock body comprised of an elastomeric material formed to exert a compressive force against said leg, wherein said elastomeric material provides said compressive force as being graded throughout the calf portion such that said gradient varies from a maximum proximate said foot to a minimum at said proximal end, and a cushioning member disposed in a heel area of said sock portion to cushion and protect the heel of said wearer's foot when said wearer is engaged in activity; and wherein said pair of socks being worn while the user is engaged in athletic activity, said sport sock enhancing cardiovascular return to improve sport performance.

* * * * *